United States Patent [19]

Ward

[11] Patent Number: 4,893,368

[45] Date of Patent: Jan. 16, 1990

[54] DRIVEWAY SCRUBBER

[76] Inventor: Justin Ward, 895 Alveda Ave., El Cajon, Calif. 92019

[21] Appl. No.: 272,917

[22] Filed: Nov. 18, 1988

[51] Int. Cl.[4] ..... E01H 1/05

[52] U.S. Cl. ..... 15/79 A; 15/49 C; 15/82

[58] Field of Search ..... 15/49 C, 50 C, 79 R, 15/79 A, 82, 83

[56] References Cited

U.S. PATENT DOCUMENTS

| | | | |
|---|---|---|---|
| 2,749,564 | 6/1956 | Tally | 15/79 A |
| 3,748,675 | 7/1973 | Schultz | 15/79 A |
| 4,602,400 | 7/1986 | Agergard | 15/79 A |

*Primary Examiner*—Edward L. Roberts
*Attorney, Agent, or Firm*—Charles C. Logan, II

[57] ABSTRACT

A power driven driveway scrubbing apparatus formed from the following major components: an outer base housing, an inner base housing, and a push handle assembly. A pair of laterally spaced front wheels are mounted on a front axle that passes through said inner base housing. The rear wheels are mounted on separate rear axles that merely extend laterally from the outer base housing. The inner base housing has a top wall, front wall, rear wall, and laterally space side walls. Its side walls have apertures adjacent the front end of the respective side walls through which the front axle passes thereby allowing the inner base housing to be pivoted about the front axle. A cylindrical brush member extends laterally within the inner base housing and it is mounted on a shaft having its opposite ends connected to the respective side walls of the inner base housing. The push handle assembly is pivotally attached to the lateral sides of the outer base housing and it has structure for applying a downward force to the top wall of the inner base housing thereby causing the cylindrical brush member to be forced downwardly against the surface beneath the scrubbing apparatus.

7 Claims, 1 Drawing Sheet

DRIVEWAY SCRUBBER

BACKGROUND OF THE INVENTION

The invention relates to scrubbing devices and more specifically to a power driven driveway scrubbing apparatus.

Presently when people owning homes having carpeted floors desire the carpets to be cleaned, they either hire private carpet cleaners or rent carpet cleaning machines which they personally use. Often overlooked during this proceedure is the fact that a great deal of the stains found on the carpets have been tracked in from people's shoes that have walked on the oil and grease stained driveway of their own home. As a result, they are merely cleaning the carpet but not removing the source or cause from which the stains come from.

It is an object of the invention to provide a novel power driven driveway scrubbing apparatus that can be used to remove greasy film and stains from the surface of the driveway at the same time the carpets in the house are cleaned.

It is also an object of the invention to provide a novel power driven driveway scrubbing apparatus that is easily operated by either a technican or the home handyman.

It is another of the invention to provide a novel power driven driveway scrubbing apparatus that can be easily transported to the site it is to be used.

It is a further object of the invention to provide a novel power driven driveway scrubbing apparatus that would require relatively little or no maintenance.

SUMMARY OF THE INVENTION

Applicant's novel power driven driveway scrubbing apparatus is relatively easy to operate. It has an electric motor that would be connected to an electric outlet by an electrical extension cord. The operator pushes the apparatus by holding the handgrip on the push handle assembly. The apparatus can be turned by applying force to either the left or right side. In its state prior to having the scrubbing operation, the height of the inner base housing is such that the cylindrical brush member extending laterally therewithin does not contact the driveway surface. Only after the downward force is applied to the push handle assembly is the cylindrical brush member brought into contact or engagement with the drive way surface. This is accomplished due to the fact that the inner base housing has its forward end journaled on the front axle that passes through it and the side walls of the outer base housing. The rear end of the inner base housing resiliently floats at a predetermined height as a result of the recoil spring assemblies that have their respective ends attached to the respective inner and outer base housings.

There is also brake structure that allows the rear wheel of the scrubbing apparatus to be locked firmly in order to continue the scrubbing opertion at the same spot for a desired period of time. This brake may be operated by a hand actuating lever mounted on a hand grip of the handle cross member.

There is also braking structure that will prevent the rear of the inner base housing from being telescopically pushed downwardly into the outer base housing. This locking structure is operated when the operator desires to change the direction of travel of the driveway scrubbing apparatus much in the manner that is used to steer a motorized lawn mower. A nand actuating lever for controlling this structure is also mounted on the handle cross member.

In operation a soap or detergent would generally be applied to the surface of the driveway first prior to operation of the power driven driveway scrubbing apparatus thereon. The cylindrical brush member would be a single elongated brush or it could be composed of a series of smaller members stacked together. The stiffness of the bristles could be varied depending upon the surface being scrubbed. By innerchanging the cylindrical brush member with wire brush members, the apparatus could be used for removing paint or varnish from floor surfaces. The rear wall of the outer base housing functions as a shroud that prevents dirt, etc., from being kicked back on the user of the apparatus during its scrubbing operation.

DESCRIPTION OF THE PREFERRED EMBODIMENT

Figure 1:
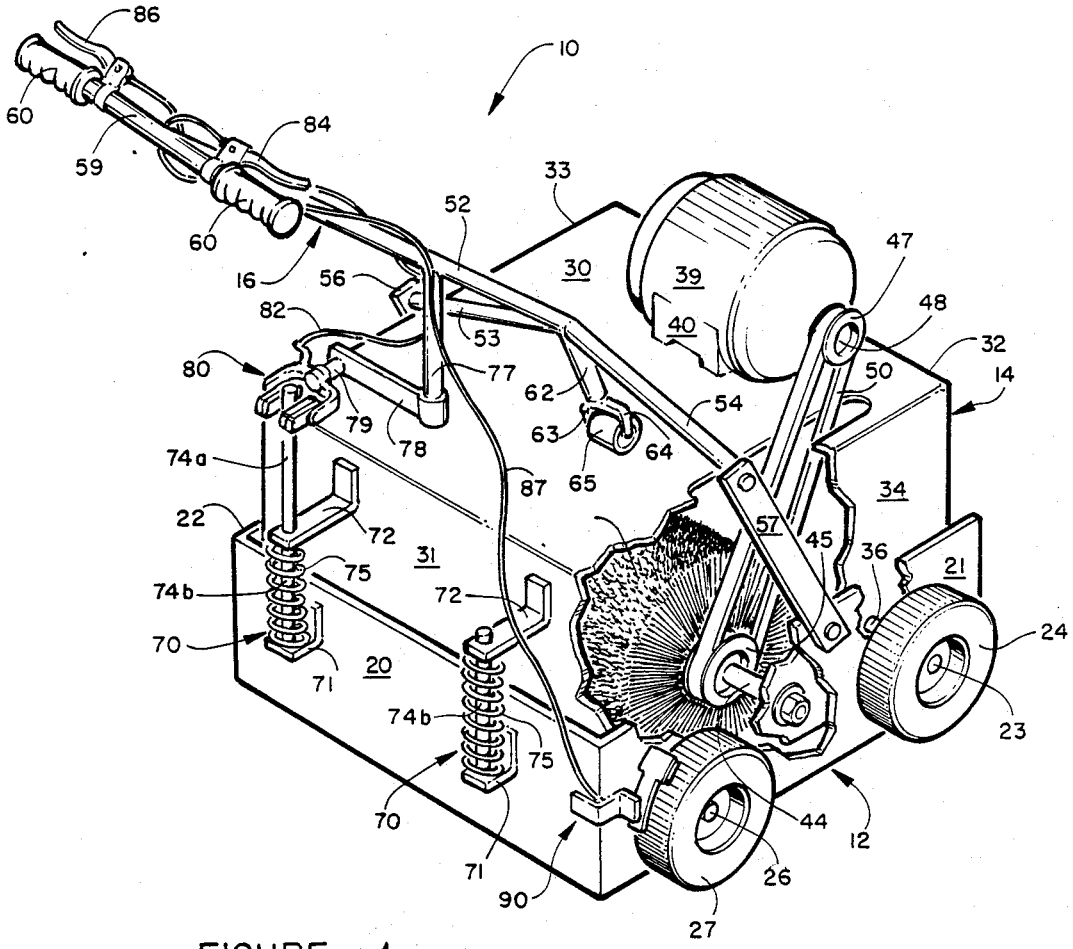
FIG. 1 is a front perspective view of applicant's novel power driven driveway scrubbing apparatus.
Figure 2:
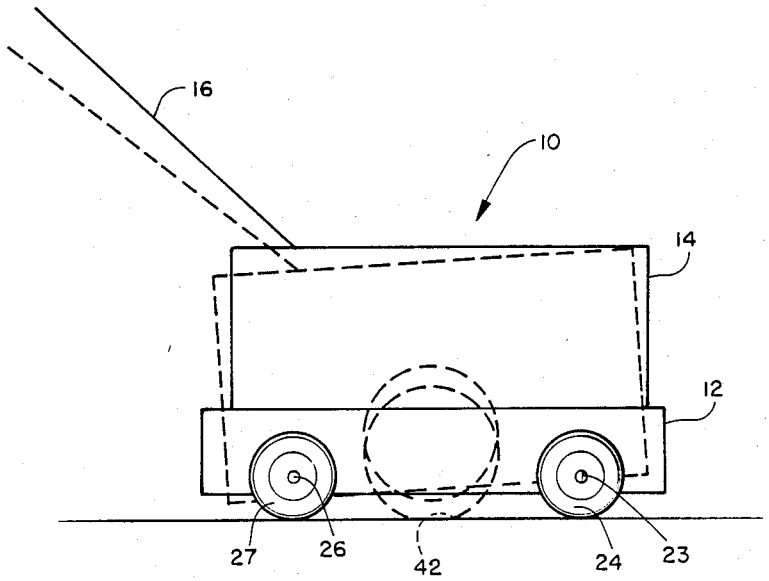
FIG. 2 is a schematic side elevation view indicating the manner in which the rear of the inner base housing is depressed in order to bring the cylindrical brush member into contact with the driveway surface.

Applicant's novel power driven driveway scrubbing apparatus will now be described by referring to FIGS. 1 and 2 of the drawing. The scrubbing apparatus is generally designated numeral 10.

Scrubbing apparatus 10 is formed from the following major components: outer base housing 12, inner base housing 14, and push handle assembly 16.

Outer base housing 12 has a rear wall 20, and laterally spaced side walls 21 and 22. A front axle 23 extends entirely across the width of outer base housing 12 and it has front wheels 24 mounted on its respective ends. Separate pairs of rear axles 26 each have a rear wheel 27 mounted thereon.

Inner base housing 14 has a top wall 30, a rear wall 31, a front wall 32, and side walls 33 and 34. Apertures 36 are formed in the respective side walls 33 and 34 adjacent their forward ends and front axle 23 is journaled therein. An electric motor 39 is attached by bracket 40 to top wall 30. A cylindrical brush member 42 is mounted on a shaft 44 whose opposite ends are supported in the respective side walls 21 and 22 of outer base 12. A pulley 45 is mounted on shaft 44. A pulley 47 is mounted on the drive shaft 48 of electric motor 39. A closed loop drive belt 50 passes around the respective pulleys 45 and 47.

Push handle assembly 16 has an elongated main tubing member 50 having laterally extending tubing leg members 53 and 54 connected to its bottom end. Leg members 56 and 57 are attached to the bottom ends of the respective tubing members 53 and 54 and they have their bottom ends pivotally secured to the respective side walls 22 and 21 of the outer base housing. A handle cross member 59 is connected to the top end of main tubing member 52 and it has hand grips 60 mounted on each of its ends.

it is the downward force applied to the handle cross member 59 that forces roller 65 against the top wall 30 of inner base housing causing its rear end to pivot downwardly about the front axle 3 and cause the cylindrical brush member 42 to engage the driveway surface.

A pair of recoil spring assemblies 70 are mounted on the rear of the scrubbing apparatus 10. These assemblies each have a bracket 71 that is mounted on rear wall 20. Each have a bracket 72 that is mounted on rear wall 31. One assembly has a rod 74A and the other has a rod 74B and they each have their bottom ends secured to their own bracket 71 and a coil spring 75 is passed downwardly over them. A tubing member 77 extends downwardly from main tubing member 52 and its bottom end has a horizontal arm member 78 attached thereto. A rod 79 extends from one end of horizontal arm member 78 and it has a caliper brake unit 80 mounted thereon. A cable 82 has its one end connected to caliper brake unit 80 and its other end attached to actuating lever 84. When handle cross member 59 is pushed downwardly to cause cylindrical brush member 42 to engage the driveway surface, actuating lever 84 is squeezed. This causes caliper brake unit 80 to grip rod 74A and keep the cylindrical brush member in contact with the driveway without the need to keep pressing downwardly on handle cross member 59. Actuating lever 86 is attached to cable 87 whose opposite end is attached to rear wheel brake assembly 90.

What is claimed is:

1. A power driven driveway scrubbing apparatus comprising:

an outer base housing having a rear wall with laterally spaced side structural members extending forwardly from its opposite ends, a front axle extending laterally through and extending outwardly from each of said respective side walls, front wheels mounted on opposite ends of said front axle, a pair of rear wheels each of which is mounted on its own separate axle that extends outwardly from said respective side structural members;

an inner base housing having a top wall, a front wall, a rear wall, and laterally spaced side walls, said inner base housing being physically located within said outer base housing, said front axle being journaled in apertures in the respective side walls of said inner base housing so that the inner base housing may be pivoted about said front axle;

a cylindrically shaped brush located within said inner base housing and being mounted on a first shaft member having its opposite ends secured to the respective lateral side walls of said inner base housing;

a motor and means for transmitting rotational motion therefrom to said brush means;

a push handle assembly having means pivotally attaching its lower end to said outer base housing;

means to bias the inner base housing vertically with respect to said outer base housing; and means connected to said push handle assembly for rotating the rear end of said inner base housing downwardly about said front axle thereby causing said cylindrically shaped brush to be forced into scrubbing contact with the surface upon which said scrubbing apparatus is traveling over.

2. A power driven driveway scrubbing apparatus as recited in claim 1 wherein said motor is mounted on the top of said inner base housing.

3. A power driven driveway scrubbing apparatus as recited in claim 1 further comprising brake means for one of said rear wheels.

4. A power driven driveway scrubbing apparatus as recited in claim 1 wherein said shaft member is located rearwardly of said front axle.

5. A power driven driveway scrubbing apparatus as recited in claim 1 wherein said push handle assembly comprises an elongated main tubing member having a top end and a bottom end, a laterally extending cross member is connected to said top end to form a T-shaped configuration, two leg members extend in opposite lateral directions and have their top ends rigidly connected to the bottom end of said main tubing member and their bottom ends pivotally connected to the respective laterally spaced structural members of said outer base housing.

6. A power driven driveway scrubbing apparatus as recited in claim 5 further comprising means for locking said outer base housing against downward telescopic movement with respect to the rear end of said inner base housing.

7. A power driven driveway scrubbing apparatus as recited in claim 6 further comprising a recoil spring assembly means for keeping the rear end of said outer base housing and inner base housing biased vertically apart from each other.

* * * * *